US006345816B1

(12) United States Patent
Fitzpatrick

(10) Patent No.: US 6,345,816 B1
(45) Date of Patent: Feb. 12, 2002

(54) HYDRAULIC VISE JAWS

(75) Inventor: John P. Fitzpatrick, Troy, MI (US)

(73) Assignee: Snap Jaws Manufacturing Co., Troy, MI (US)

( * ) Notice: Subject to any disclaimer, the term of this patent is extended or adjusted under 35 U.S.C. 154(b) by 0 days.

(21) Appl. No.: 09/569,201

(22) Filed: May 11, 2000

(51) Int. Cl.[7] ..... B25B 1/24
(52) U.S. Cl. ..... 269/266; 269/20; 269/267; 269/282
(58) Field of Search ..... 269/266, 20, 26, 269/267, 282

(56) References Cited

U.S. PATENT DOCUMENTS

| | | | | |
|---|---|---|---|---|
| 1,453,176 A | | 4/1923 | Perrine | |
| 2,399,824 A | | 5/1946 | Pressman | |
| 2,882,771 A | | 4/1959 | Blazek | |
| 3,868,102 A | | 2/1975 | Pevar | |
| 4,008,886 A | | 2/1977 | Murdoch | |
| 4,088,312 A | | 5/1978 | Frosch et al. | |
| 5,152,707 A | * | 10/1992 | Dougherty et al. | 269/266 |
| 5,884,906 A | | 3/1999 | Morse | |

FOREIGN PATENT DOCUMENTS

| | | |
|---|---|---|
| EP | 0115474 | 8/1984 |
| EP | 0507040 | 7/1992 |

* cited by examiner

*Primary Examiner*—Robert C. Watson
(74) *Attorney, Agent, or Firm*—Carlson, Gaskey & Olds

(57) ABSTRACT

An improved hydraulic vise jaw incorporates a fluid supply which communicates hydraulic fluid to an area behind a plurality of pistons such that the pistons are held outwardly against a part with a generally uniform force. Each piston is positioned in a piston cylinder. The piston cylinders are arranged in several columns and a supply passage connects each of the piston cylinders in an upper row and a second supply passage connects each of the piston cylinders in a lower row. A communication hole selectively connects a first piston cylinder in the top row with a second piston cylinder in the bottom row. Preferably, the communication hole connects piston cylinders which are in distinct columns. In this way, the flow of hydraulic fluid between the rows is somewhat restricted such that an equal and adequate holding force is maintained on the pistons. In another feature, a pin selectively holds the pistons within the piston cylinders such that they are prevented from moving outwardly of the body. Preferably, the pistons include a slot which extends for a dimension greater than the dimension of the pin. In this way, the pistons can move relative to the pin. A single pin holds the pistons associated with each of the upper and lower rows.

19 Claims, 2 Drawing Sheets

HYDRAULIC VISE JAWS

BACKGROUND OF THE INVENTION

This invention relates to an improved multiple position hydraulic vise jaw that adjusts to accommodate various sized parts.

In the prior art, vise jaws are utilized in conjunction with vises to clamp and hold various parts. In industrial machining operations, vise jaws are utilized to hold one or two parts at one time. The parts are often of similar shape and size, and modern vise jaws are called upon to hold the parts securely.

In the prior art there has been much trouble in holding several parts in that tolerances always result in the parts having slightly different sizes. When there are several parts having slightly different sizes being held, it is not possible for a single clamp surface to adequately hold the several parts with an equal and adequate holding force, i.e., large parts are secure and small parts are lose.

Hydraulic vise jaws are also known wherein a hydraulic fluid selectively biases piston members outwardly from the jaw such that the position of the pistons change to accommodate the shape of the particular part being held. These hydraulic jaws have typically had a separate reservoir for the hydraulic fluid for each row. Therefore, if only one piston in a row was required to hold a part, all the other piston s would extend due to the hydraulic fluid.

It would be desirable to improve the operation of the known hydraulic jaws.

SUMMARY OF THE INVENTION

In the disclosed embodiment of this invention, a hydraulic jaw has a series of hydraulic piston cylinders arranged in columns and at least a pair of rows. The hydraulic piston cylinders act as reservoir for a hydraulic fluid. Hydraulic piston elements are received in the hydraulic piston cylinders and are biased outwardly to contact several parts. The pistons can move inwardly or outwardly of the vise jaw body to accommodate varying sizes in the parts being held.

Some prior art hydraulic jaws had a series of rows and columns of pistons. The hydraulic fluid did not connect between the rows, or alternatively, there was an separate reservoir which did not provide equal and adequate force against the rear of the pistons. In the present invention, a small hole connects the hydraulic fluid between the two rows. In this way, the hydraulic fluid is allowed to move between the two rows which maintains an equal and adequate force behind the pistons. In a preferred embodiment, one of the piston cylinders on the top row is connected to one of the piston cylinders on the bottom row which allows the hydraulic fluid to flow between both rows and columns. More preferably, the two piston cylinders are connected in distinct columns such that the hydraulic fluid flow is further regulated. In this way, the force maintained on the rear of the piston is still maintained at a sufficiently high level such that the pistons securely hold the parts.

In another feature, the pistons in each row are held against undue movement by a pin extending through a slot in the piston. The single pin extends from an end surface of the jaw body through slots on the pistons. The pistons are thus allowed to move, while still being restricted against undue movement outwardly from the body. Another advantage of the subject invention allows one or two pistons to operate in a mechanical mode while the remaining pistons are held in a neutral position.

These and other features of the present invention can be best understood from the following specification and drawings, the following which is a brief description.

DETAILED DESCRIPTION OF A PREFERRED EMBODIMENT

Figure 1:
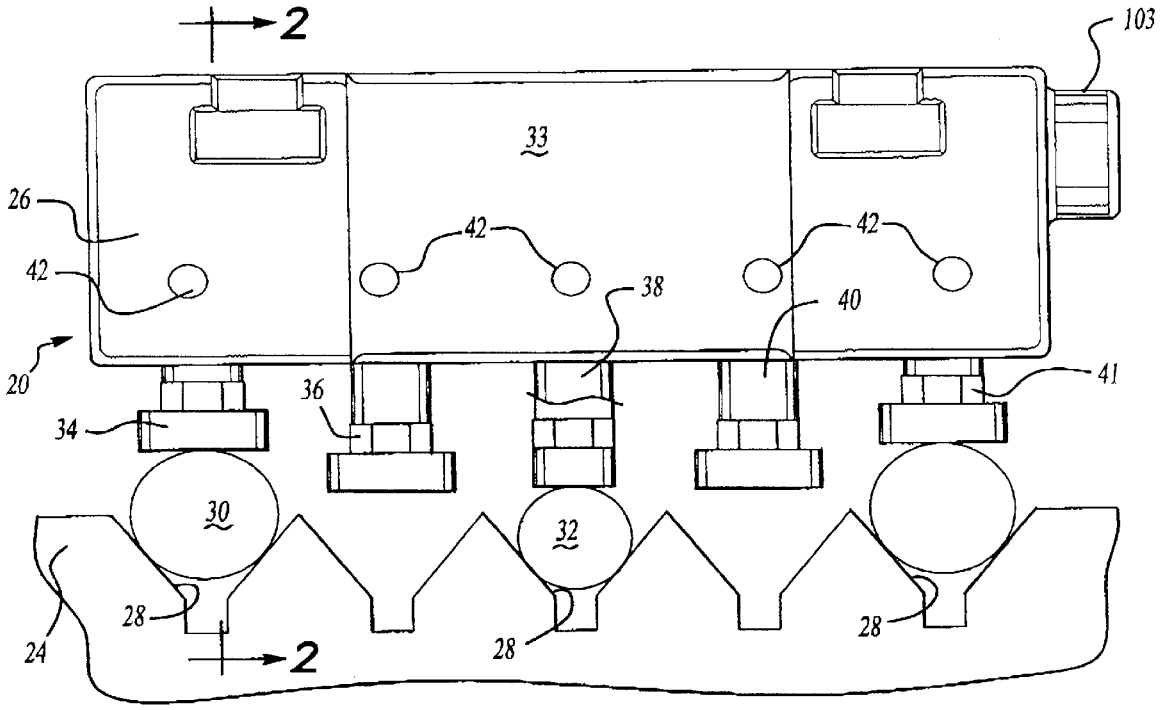
FIG. 1 is a top view showing a clamp set-up holding several parts.

FIG. 1 shows a clamping operation 20 incorporating one vise jaw 24 and a second hydraulic vise jaw 26. The vise jaw 24 is provided with V-shaped part locating areas 28. As shown, a pair of parts 30 and 32 are received within the V-shaped part locating areas 28.

As discussed above, in a typical machining operation, the parts 30 and 32 have approximately equal outer diameters. However, due to acceptable tolerances, there may be some slight differences. Notably they are shown to be quite different to better illustrate this fact. The prior art clamps have had difficulty in accommodating those differences while still providing an equal and adequate holding force on the parts. The present invention is directed to overcoming that problem.

As shown, jaw body 33 carries a number of pistons 34, 36, 38, 40 and 41. A second set of pistons 34', 36', 38', 40' and 41' are spaced vertically out of this figure. The pistons are driven outwardly to hold parts, and a hydraulic force forces them outwardly against the parts 30 and 32. Thus, if part 32 has a somewhat smaller outer diameter than part 30, the piston 38 will be driven further outwardly than the piston 34 to accommodate this difference. However, since the hydraulic fluid does connect between the various pistons, as will be described below, the holding force on the parts 30 and 32 is extremely uniform.

In another feature, openings 42 on the upper surface of the body 33 accommodates pins which restrict movement of the pistons outwardly of the body 33.

Figure 2:
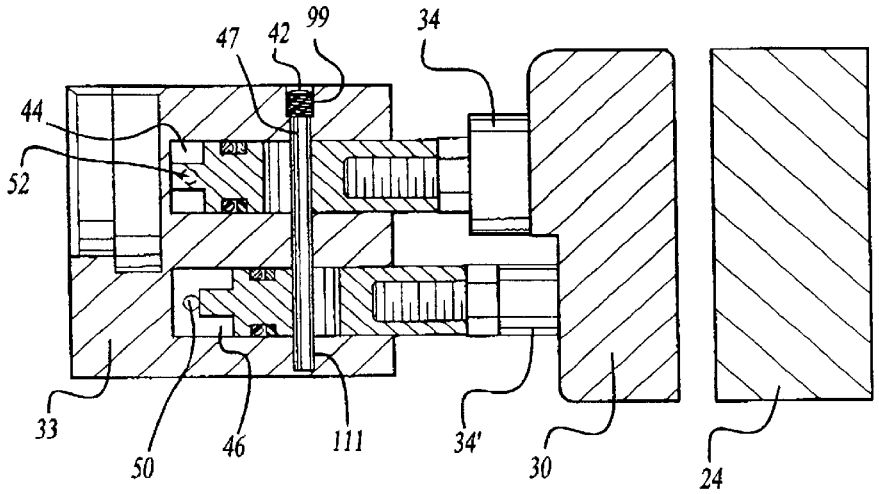
FIG. 2 is a cross-sectional view along line 2—2 as shown in FIG. 1.

FIG. 2 shows the pin 47 extending through opening 42, and through slot s 48 in the pistons 34 and 34'. As shown, a single pin 47 extends through the slots 48 in both of the pistons 34 and 34'.

A chamber 44 is shown rearwardly of the piston 34 and a chamber 46 is shown rearwardly of the piston 34'. A supply passage 50 connects a series of piston cylinders 46 receiving pistons 34', 36', 38', 40', and 41'. Similarly, a passage 52 connects the piston cylinders 44 associated with the pistons 34, 36, 38, 40 and 41. The piston cylinders 44 and 46 act as a reservoir for a hydraulic fluid.

As can be appreciated from FIG. 2, if the part 30 is nonuniform along its axial length, the piston 34' may move more or less than the piston 34. Again, the hydraulic vise jaw 26 and the force behind the several pistons accommodate these different sizes while still providing a equal and adequate holding force. As shown pin 47 is threaded at 99 into a first bore 111 in body 33. This allows easy disassembly.

Figure 3:
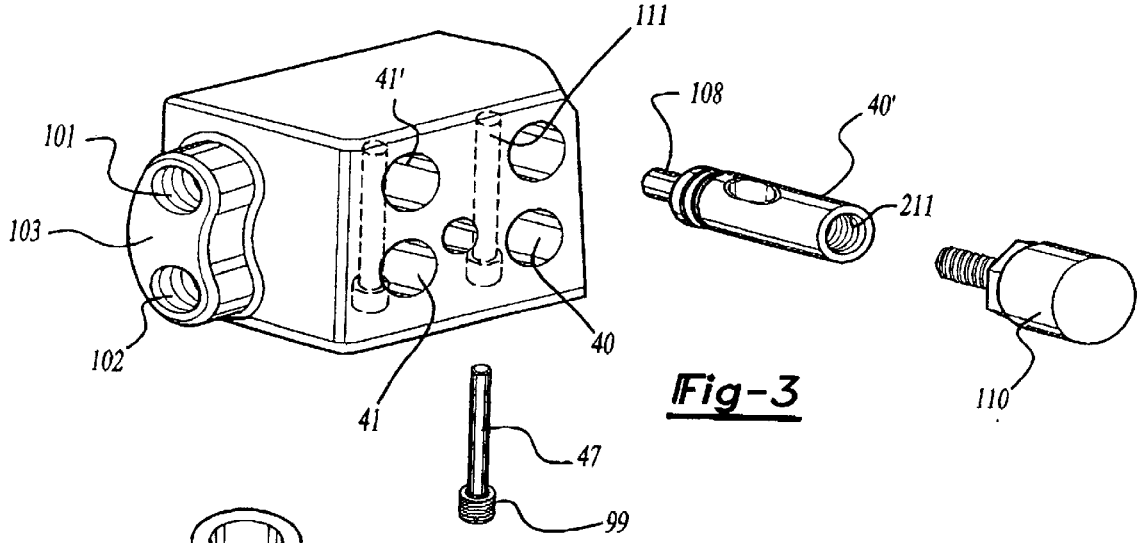
FIG. 3 is a partial front view of the vise jaw.

FIG. 3 shows a supply boss 103 comprising supply ports 101 and 102 which are used to fill passages 50 and 52 the supply ports 101 and 102 are threaded for insertion of a screw (not shown). The screw (not shown) can be easily removed. As also shown, piston 40' has a forward portion 110 which is threaded into a second bore 211 and actually contacts the part. The forward portion 110 provides a holding surface and is interchangeable to accommodate various shaped parts. Also changing portion 10 can provide various types of holding surfaces. Examples include aluminum, swivel tip, carbide, serrated, steel, stainless steel, brass and nylon.

Figure 4:
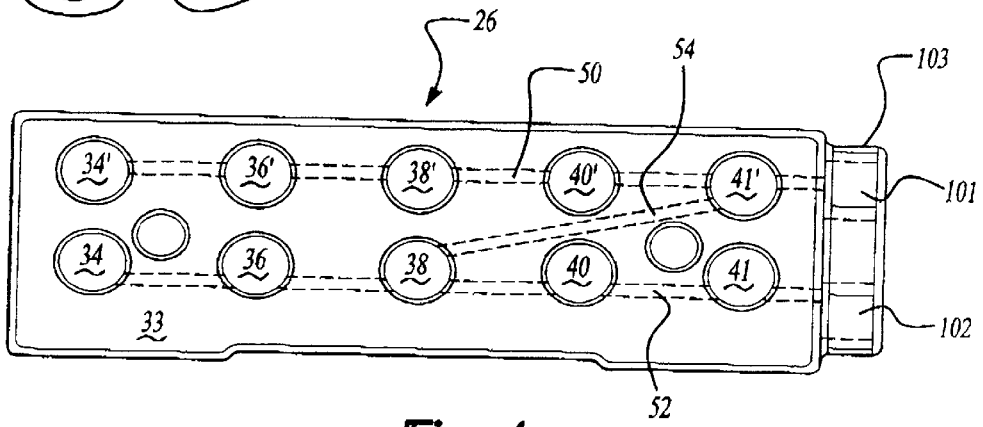
FIG. 4 is an end view of a vise jaw according to the present invention.

FIG. 4 shows the hydraulic jaw 26 and its body 33 accommodating the several pistons. The pistons are arranged in a number of columns, identified by the numbers 34, 36, 38, 40 and 41. Further, the pistons are arranged in two rows, with the reference numerals being identified by either no prime or the prime symbol (').

As can be appreciated, the passage 50 and 52 extend from a lateral edge of the body 33 through each of the piston cylinders 44 and 46, as explained with reference to FIG. 2. The hydraulic jaw fluid structure as described to this point is roughly as known in the art. The present invention improves upon this basic structure by having a restricted communication hole 54 communicating one piston cylinder in one row and column with a distinct piston cylinder in a distinct row and column. In this way, the hole 54 allows communication between the two rows and the passages 50 and 52, while still restricting the flow of fluid between the two. In this way, the force behind the pistons is equal and adequate to hold the pistons against the part.

Figure 5:
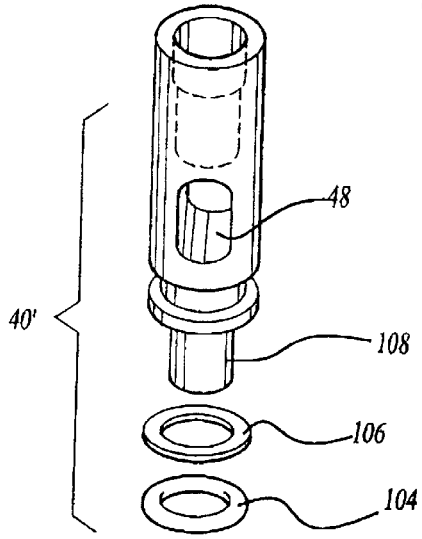
FIG. 5 shows a piston according to the present invention.

As shown in FIG. 5, here each piston 40' has a slot 48 for accommodating the pin 47. It should be understood that the other pistons have similar structure. The slot 48 is longer than the diameter of the pin 47 such that the piston 40' can move relative to the pin for some extent. If a single part is placed in the jaw 26, the piston 40' may operate mechanically instead of hydraulically. As the jaw 26 is closed, the jaw 26 creates a force on the part and the piston 40' is forced into the piston cylinder. The piston 40' has a stop element 108 that contact the jaw body 33. The remaining pistons, which are not in use, rest in a neutral position due to the pin 47. The piston 40' also includes an o-ring 104 and a back up o-ring 106. The o-ring 104 seals the piston cylinder which prevents the hydraulic fluid from leaking. As more force is applied to the piston, the o-ring 104 has a tendency to twist creating leaks. However, the back up o-ring 106 provides additional support for the o-ring 104 which prevents the o-ring 104 from leaking and twisting.

Although a preferred embodiment of this invention has been disclosed, a worker in this art would recognize that modifications would come within the scope of this invention. For that reason, the following claims should be studied to determine the true scope and content of this invention.

What is claimed is:

1. A vise jaw for use on a vise comprising:

a vise jaw body having a top and bottom surface and two lateral ides;

a plurality of piston cylinders arranged in at least two rows and a plurality of columns; supply passages communicating with all of said piston cylinders in each of one of said rows;

pistons in each of said piston cylinders and a communication hole communicating with one of said piston cylinders in one row and one column with another of said piston cylinders in a distinct row and a distinct column.

2. A jaw as recited in claim 1, wherein there are two of said rows and more than two of said columns, said supply passages communicating each of said piston cylinders on each of said rows, and said communication hole communicating said piston cylinder in a top row with said piston cylinder in a bottom row which are in distinct columns.

3. A jaw as recited in claim 1, wherein each of said pistons having a forward portion.

4. A jaw as recited in claim 1, wherein a pin selectively secures each of said pistons in said piston cylinder.

5. A jaw as recited in claim 4, wherein a single pin extends through said jaw body to secure said pistons associated with said columns in said jaw body.

6. A jaw as recited in claim 4, wherein each of said pistons have elongated slots which extend for a distance greater than the thickness of said pin, such that each of said pistons may move relative to said pin, and said pin extending through said slots.

7. A jaw as recited in claim 6, wherein said pin is threaded into said jaw body.

8. A jaw as recited in claim 3, wherein each of said pistons includes a stop for maintaining a distance between said jaw body and said forward portion.

9. A jaw as recited in claim 3, wherein said piston is threaded for receiving a plurality of different shaped forward portions.

10. A jaw as recited in claim 1, wherein said piston includes a back up o-ring for sealing said piston cylinder.

11. A jaw as recited in claim 1, wherein a supply boss is fixedly attached to said jaw body, said supply boss having at least one supply port for access to said supply passage, and said supply port being threaded for sealing said supply passage.

12. A vise jaw for use on a vise comprising:

a vise jaw body having a top and bottom surface and two lateral sides; a plurality of piston cylinders arranged in at least one row;

a piston slidably disposed in each of said piston cylinders;

a supply passage communicating with all of said piston cylinders of said row; and a pin for each of said pistons to prevent overextension of said pistons.

13. The vise jaw of claim 12, wherein each of said pistons includes a slot, and said pin extends through said slot.

14. The vise jaw of claim 12, further including at least one additional row of piston cylinders and pistons to form a column, and said pin extends through a slot in at least two of said pistons in said column.

15. The vise jaw of claim 14, wherein said slots include a width greater than a thickness of said pin, such that each of said pistons may move relative to said pin.

16. The vise jaw of claim 1, wherein said communication hole defines a direct line passage between a piston cylinder in one row and one column and another piston cylinder in a distinct row and a distinct column.

17. The vise jaw of claim 1, wherein said rows and columns form an array, said rows define an upper and lower boundary of said array and said columns define a left and right boundary of said array and said communication hole is disposed within said array.

18. A vise jaw for use on a vise comprising:

a vise jaw body having a top and bottom surface and two lateral sides;

a plurality of piston cylinders arranged in at least two rows and a plurality of columns;

supply passages communicating with all of said piston cylinders in each of one of said rows;

pistons in each of said piston cylinders;

a communication hole communicating with one of said piston cylinders in one row and one column with another of said piston cylinders in a distinct row and a distinct column; and a pin selectively secures each of said pistons in said piston cylinder.

19. A vise jaw for use on a vise comprising:

a vise jaw body having a top and bottom surface and two lateral sides;

a plurality of piston cylinders arranged in at least two rows and a plurality of columns;

supply passages communicating with all of said piston cylinders in each of one of said rows;

pistons in each of said piston cylinders and each of said pistons include threads for receiving a plurality of differently shaped forward portions a communication hole communicating with one of said piston cylinders in one row and one column with another of said piston cylinders in a distinct row and a distinct column.

* * * * *